US006018926A

United States Patent [19]

Chen-Chao

[11] Patent Number: 6,018,926

[45] Date of Patent: Feb. 1, 2000

[54] BANNER POLE STRUCTURE

[76] Inventor: Huang Chen-Chao, No. 20, Lane 124, Sec. 5, Hsin Hai Road, Taipei, Taiwan

[21] Appl. No.: 09/080,282

[22] Filed: May 18, 1998

[51] Int. Cl.[7] ..... E04G 1/06

[52] U.S. Cl. ..... 52/736.1; 52/736.4; 52/726.1; 52/301; 116/63 R; 403/DIG. 8

[58] Field of Search ..... 52/736.1, 736.4, 52/726.1, 301; 116/63 R, 63 P, DIG. 21; 403/DIG. 8, 366, 409.1, 110

[56] References Cited

U.S. PATENT DOCUMENTS

| | | | |
|---|---|---|---|
| 1,989,861 | 2/1935 | Hixon | 52/409.1 |
| 2,256,248 | 9/1941 | Hansen | 52/DIG. 8 |
| 2,748,745 | 6/1956 | Pobanz et al. | 116/173 |
| 2,781,017 | 2/1957 | Fuller et al. | 116/63 |
| 2,941,185 | 6/1960 | Mullikin | 340/41 |
| 3,105,459 | 10/1963 | Conn | 116/124 |
| 3,225,734 | 12/1965 | Bule | 116/173 |
| 3,421,473 | 1/1969 | Weichenrieder | 116/63 |
| 4,076,437 | 2/1978 | Mazzolla | 403/350 |
| 4,144,833 | 3/1979 | Newman, Sr. | 116/28 R |
| 4,201,975 | 5/1980 | Marcus | 340/84 |
| 4,636,109 | 1/1987 | Clausen et al. | 404/10 |
| 4,949,525 | 8/1990 | Weaver | 52/720 |
| 5,363,607 | 11/1994 | Turturro | 52/40 |
| 5,913,634 | 6/1999 | Heilig | 403/374.1 |

*Primary Examiner*—Carl D. Friedman
*Assistant Examiner*—Phi Dieu Tran A
*Attorney, Agent, or Firm*—Rosenberg, Klein & Lee

[57] ABSTRACT

An improved banner pole structure includes a first cylindrical tube, a pole head, a second cylindrical tube, and a bias frictional assembly. The pole head is threadedly coupled to the first cylindrical tube and the first cylindrical tube is telescopically received within the second cylindrical tube. The bias functional assembly is coupled to an end of the first cylindrical tube and frictionally engages an interior wall surface of the second cylindrical tube, responsive to rotation of the first cylindrical tube relative to the second cylindrical tube.

1 Claim, 2 Drawing Sheets

BANNER POLE STRUCTURE

FIELD OF THE INVENTION

The present invention refers to an improved banner pole structure, more particularly relates to a main pole comprising more than one metal cylindrical tubes with woody coated surface, and having a threaded cylinder formed thereon for coupling a banner pole head.

BACKGROUND OF THE INVENTION

As for conventional banner pole structure, some are made of aluminum alloy to remain the metal shine of aluminum alloy which has more exquisite looking and lighter weight than plastic or wooden pole. However, after a period of time of using, the pole may be stained with gray or black print of hand or oxygenating with air. Further, as far as conventional banner pole is concerned, a plastic made threaded cylinder is formed for coupling to the top end of banner pole for screwing up different pole heads. Inventor of this invention has been undertaking manufacture of conventional banner pole for years and he found making plastic pole head requires expensive mold and material as well as laboring cost for processing and assembling poles.

SUMMARY OF THE INVENTION

An improved banner pole structure , comprising more than tvo sections of metal cylindrical tubes covered with layer of woody coating with diameter being compatible for coupling with each other by a bias frictional assembly to form an extendible pole. Said pole has a first section on top end having no woody coating covered for processing to form a threaded cylinder for screwing up a banner pole head.

DETAILED DESCRIPTION OF THE INVENTION

Figure 1:
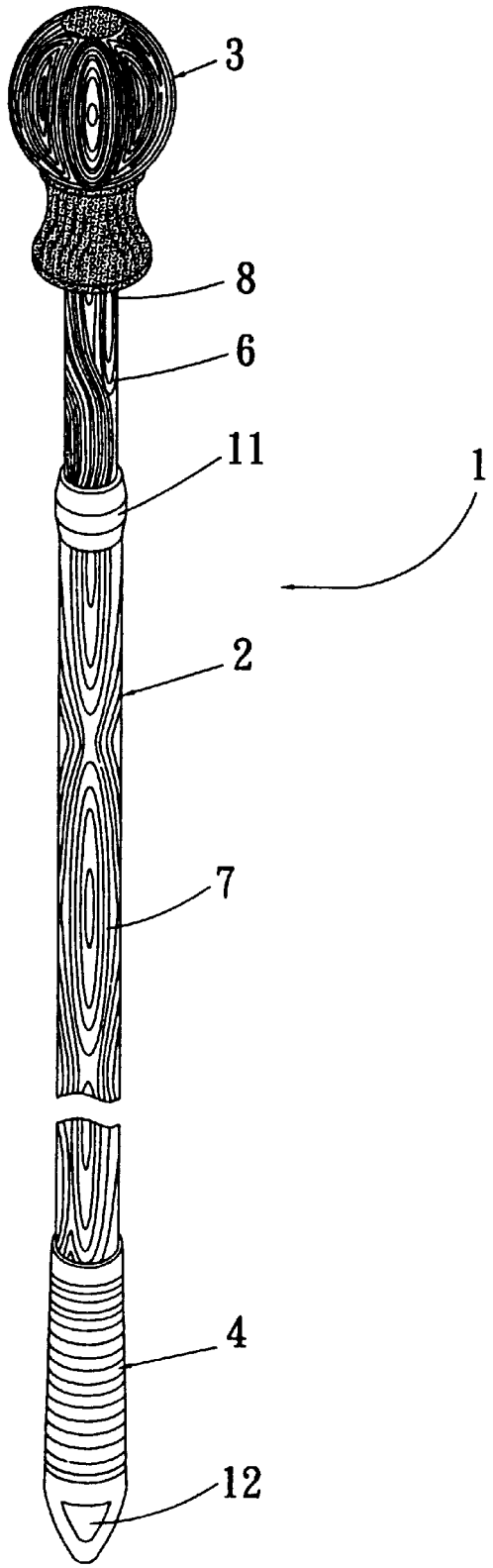
FIG. 1 is a perspective view showing a first cylindrical tube of this invention in mostly abbreviated state.
Figure 2:
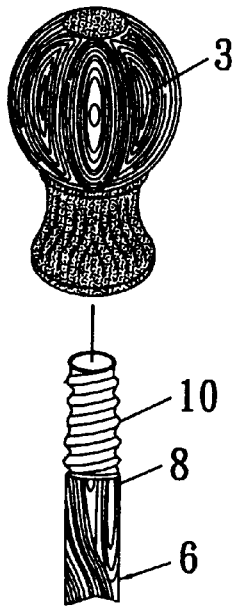
FIG. 2 is a decomposing view of a first end of first cylindrical tube, and pole head in FIG. 1 wherein some parts are not shown.
Figure 3:
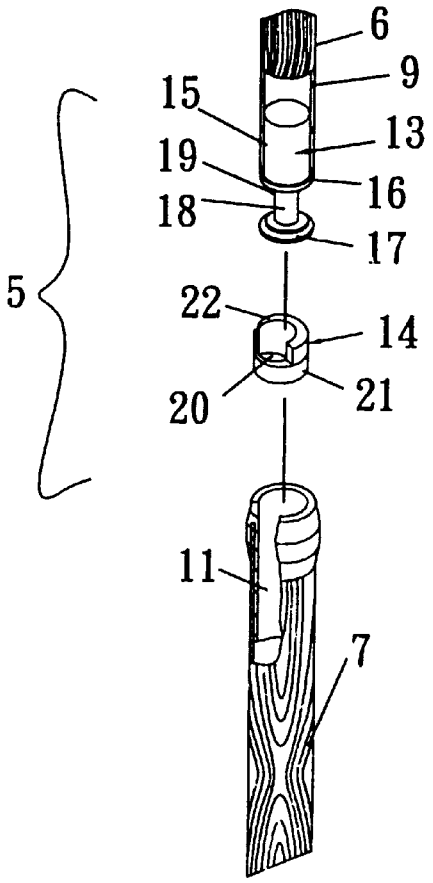
FIG. 3 is a decomposing view of a bias frictional assembly connected to second end of first cylindrical tube in FIG. 1, having some parts omitted and some in cross section.

The main pole (2) of a banner pole (1) in this invention is possibly an integrate metal tube covered with woody coating, which is not shown in drawings, or consisted of more than one metal cylindrical tubes covered with layer of woody coating being compatible for coupling with each other by a bias frictional assembly to form an extendible pole. As shown in FIGS. 1 to 3, the banner pole (1) of this preferred embodiment comprises a main pole (2), pole head (3), holder (4), and bias frictional assembly (5). Wherein, the main pole (2) is consisted of a second tube (7) coupled with a first tube (6), having a bias frictional assembly (5) connected with the second end (9) of first tube (6) and constitute inside the second tube (7) force of constrain to form an extendible pole. Said first and second tubes (6)(7) are made of metal with a layer of woody coating covering the surface thereon to prevent from being stained by hand sweating when holding the pole. Said first tube (6) has a first end (8) having no woody coating covered for processing to from a threaded cylinder (10), as shown in FIG. 2, to screw up the pole head (3). A screw hole is formed at lower end of said pole head (3) in accordance with the threaded cylinder (10) for screwing up the threaded cylinder (IO) on first end (8) of first tube (6). Said pole head (3) is optionally to be covered with woody coating or not and shaped in various forms. A bushing loop (11) is coupled on the upper end of second tube (7) of main pole (2) for covering the sharpened part of the upper end and meantime functioning to stop the bias frictional assembly (5) on first tube (1) being pulled out of the second tube (7). A holder (4) is coupled on a lover end of second tube (7) with a hanging hole (12) formed at lower side for holding or hanging the banner pole (1).

As shown in FIG. 3, the bias frictional assembly (5) connected to the second end (9) of said first tube (6) internally comprises a bias pole (13) and bias loop (14). Said bias pole (13) has a regular column (15) secured to upper end with an outer diameter in accordance with inter diameter of the second end (9) of the first tube (6). A smaller bias column (18) is formed between first and second projections (16) (17) under said regular column (15), setting a protuberance (19) under said first projection (19) for looping said bias loop (14) which is an open loop having a recess (20) at top edge for free rotation of the protuberance (19) in the first tube (6), and related thick wall (21) and thin wall (22) disposed therein for the insert of said bias pole (13) in second tube (7), constituting a contact friction between the second tube (7) and the bias loop (14) by an outwardly stretching force for secured position. By rotating the first tube (6) to make said bias column (18) correspondent with the thin wall (22) in the bias loop (14), the first tube (6) can be easily drawn out and pushed in the second tube (7), and by rotating the first tube (6) to make the protuberance (19) of said bias column (18) correspondent with the thick wall (21) in the bias loop (14), the first tube (6) is gradually secured by friction between the bias loop (14) and the second tube (7).

I claim:

1. A banner pole structure comprising:

a first cylindrical tube formed of metal and having opposing first and second ends, said first end having threads formed thereon, said first cylindrical tube having an outer surface with a wood layer formed on at least a portion thereof;

a pole head threadedly coupled to said threads on said first end of said first cylindrical tube;

a second cylindrical tube formed of metal and having an open end telescopically receiving said first cylindrical tube therein, said second cylindrical tube having an outer surface with a wood layer formed thereon; and, a bias frictional assembly coupled to said second end of said first cylindrical tube frictionally engaging an interior wall surface of said second cylindrical tube, said bias frictional assembly including (a) a bias pole having a first column portion secured to said second end of said first cylindrical tube, a second column portion extending therefrom, and a protuberance disposed below said first column, and (b) a bias loop disposed in said open end of said second cylindrical tube and surrounding said second column with said protuberance contacting an inner surface of a wall of said bias loop, said wall having a first portion and a second portion, said second wall portion being thicker than said first wall portion to thereby force said bias loop into frictional engagement with said interior wall surface of said second cylindrical tube responding to rotation of said protuberance from contact with said first portion of said bias loop wall to contact with said second portion of said bias loop wall, said protuberance being rotated concurrently with rotation of said first cylindrical tube relative to said second cylindrical tube.

* * * * *